US007762256B2

(12) United States Patent
Viljanen et al.

(10) Patent No.: US 7,762,256 B2
(45) Date of Patent: Jul. 27, 2010

(54) PROTECTIVE DEVICE

(75) Inventors: Jorma Viljanen, Mietoinen (FI); Lasse Viljanen, Turku (FI)

(73) Assignee: Euromaski Oy, Rauma (FI)

( * ) Notice: Subject to any disclaimer, the term of this patent is extended or adjusted under 35 U.S.C. 154(b) by 860 days.

(21) Appl. No.: 10/261,594

(22) Filed: Oct. 2, 2002

(65) Prior Publication Data

US 2003/0106557 A1 Jun. 12, 2003

(30) Foreign Application Priority Data

Oct. 12, 2001 (FI) ..... 20011992

(51) Int. Cl.
*A62B 18/02* (2006.01)

(52) U.S. Cl. ..... 128/206.21; 128/206.12; 128/201.23; 128/201.24

(58) Field of Classification Search ..... 128/206.19, 128/205.29, 206.12, 286.14, 206.13, 206.21, 128/206.14, 206.17, 206.18, 201.23, 201.24, 128/206.16

See application file for complete search history.

(56) References Cited

U.S. PATENT DOCUMENTS

| | | | | | |
|---|---|---|---|---|---|
| 2,681,060 | A | * | 6/1954 | Swindell | 128/206.12 |
| 4,167,185 | A | * | 9/1979 | Lewis | 128/206.24 |
| 4,361,146 | A | * | 11/1982 | Woicke | 128/206.12 |
| 4,384,577 | A | * | 5/1983 | Huber et al. | 128/206.19 |
| 4,641,645 | A | * | 2/1987 | Tayebi | 128/206.19 |
| 4,739,755 | A | * | 4/1988 | White et al. | 128/206.12 |
| 5,419,318 | A | * | 5/1995 | Tayebi | 128/205.27 |
| 5,433,192 | A | * | 7/1995 | Ebeling | 128/201.13 |
| 6,102,040 | A | * | 8/2000 | Tayebi et al. | 128/206.24 |

FOREIGN PATENT DOCUMENTS

| | | |
|---|---|---|
| DE | 93 00 181 | 3/1993 |
| EP | 0 329 941 | 8/1989 |
| GB | 695675 | 8/1953 |
| GB | 848215 | 9/1960 |
| GB | 2 264 649 | 9/1993 |
| WO | 92/19322 | 11/1992 |
| WO | WO 99/46007 | 9/1999 |

* cited by examiner

*Primary Examiner*—Darwin P Erezo
(74) *Attorney, Agent, or Firm*—Young & Thompson

(57) ABSTRACT

A protective device comprising a mask part, which covers the wearer's mouth and nose and is provided with elements through which air can be supplied inside the mask part to enable breathing. To eliminate problems caused by draught, the mask part is provided with a wall portion, which is arranged to extend from the edge portion of the mask part against the wearer's face inside the mask part so that an interspace connected to the inner space of the mask part is formed between the wall portion and the inner surface of the mask part and that the elements through which air for breathing can be supplied inside the mask part are arranged to open into the interspace.

4 Claims, 5 Drawing Sheets

PROTECTIVE DEVICE

BACKGROUND OF THE INVENTION

The invention relates to a protective device comprising a mask part, which covers the wearer's mouth and nose and is provided with means through which air can be supplied inside the mask part to enable breathing.

The above-mentioned protective devices are nowadays well known in connection with various stages of operation where fresh air for breathing has to be supplied to the worker. Examples of jobs where these situations are common include welding, grinding and cleaning. In the case of the above-mentioned jobs, the working conditions are often pretty difficult; problems are caused by high temperature and gases and impurities in the air.

Various protective devices provided with a mask part have been devised to solve the above-mentioned problem. An example of prior art solutions is the one described in Finnish application no. 973847.

The prior art solutions, such as the one according to Finnish application no. 973847, function well in principle but the draught generated by the flow of supply air has constantly caused problems. The reason for this is that some people are very sensitive to draught and the continuous air flow irritates the skin when one has to work for a long time. The problem is emphasized by the fact that the degree to which people are sensitive to draught varies greatly, i.e. even the slightest draught is uncomfortable to some people whereas the others are relatively insensitive to draught. The solution of Finnish application no. 973847 eliminates the problems caused by draught in respect of the eyes, for example, but not the problems caused by draught in the area of the wearer's nose and mouth.

SUMMARY OF THE INVENTION

The object of the invention is to provide a protective device which eliminates the drawbacks of the prior art solutions. This is achieved by a protective device according to the invention. The protective device of the invention is characterized in that the mask part is provided with a wall portion, which is arranged to extend from the edge portion of the mask part against the wearer's face inside the mask part so that an interspace connected to the inner space of the mask part is formed between the wall portion and the inner surface of the mask part, and that the means for supplying air for breathing inside the mask part are arranged to open into the interspace.

The most important advantage of the protective device according to the invention is that the flow of supply air can be guided into the mask part so that the skin is not subjected to a feeling of draught, cooling, drying or another physical or chemical undesired effect. A further advantage of the invention is that it is versatile and simple since it can be applied to very different arrangements of protective devices in a simple manner. The invention is particularly suitable for use in various protective devices used in welding, etc. Thanks to the simple structure, the invention is very economic to adopt and use.

BRIEF DESCRIPTION OF THE DRAWINGS

In the following, the invention will be described in greater detail by means of embodiments described in the attached drawing, in which.

DESCRIPTION OF THE PREFERRED EMBODIMENTS

Figure 1:
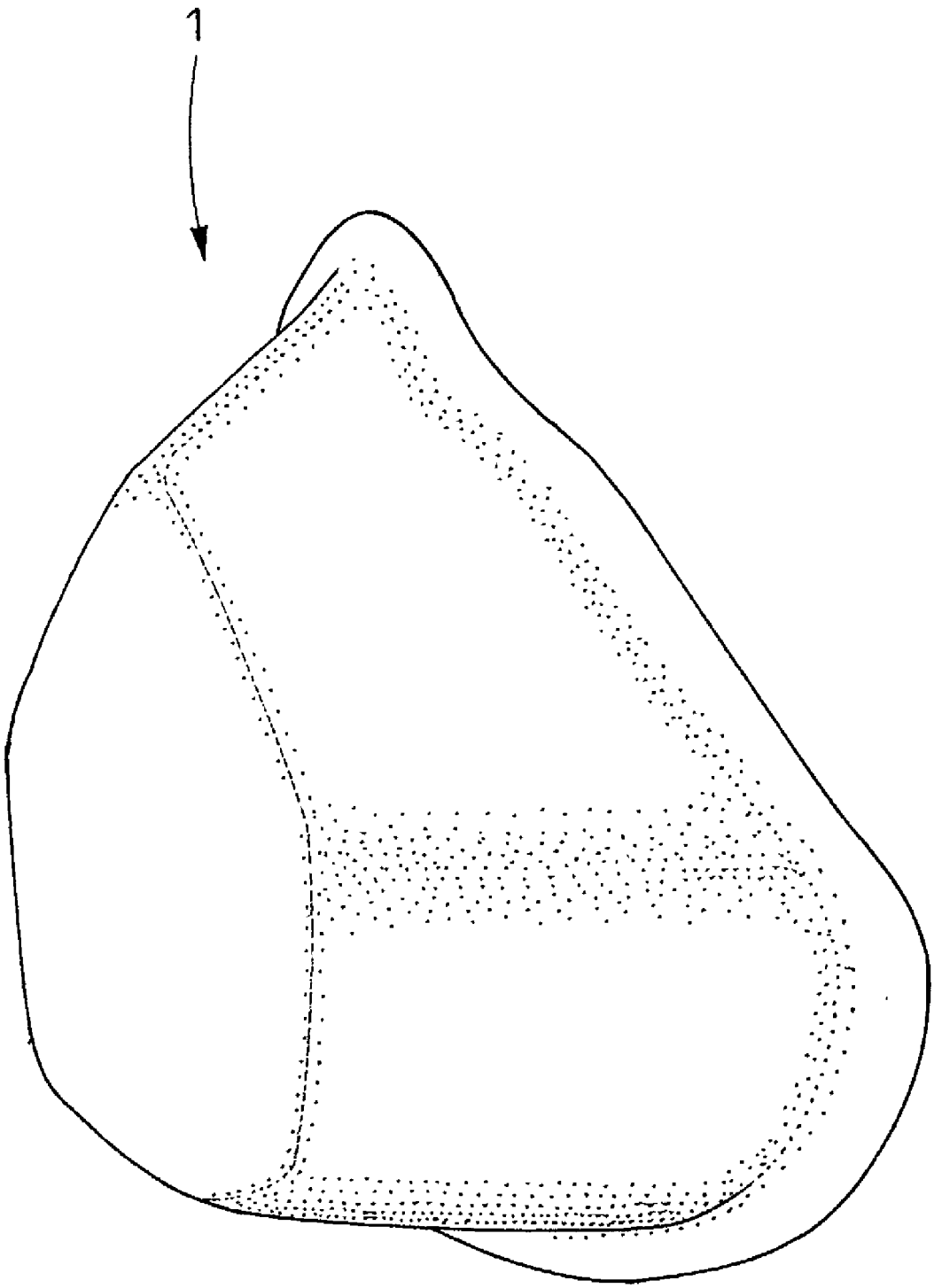
FIG. 1 is a schematic perspective view of a protective device according to the invention.
Figure 2:
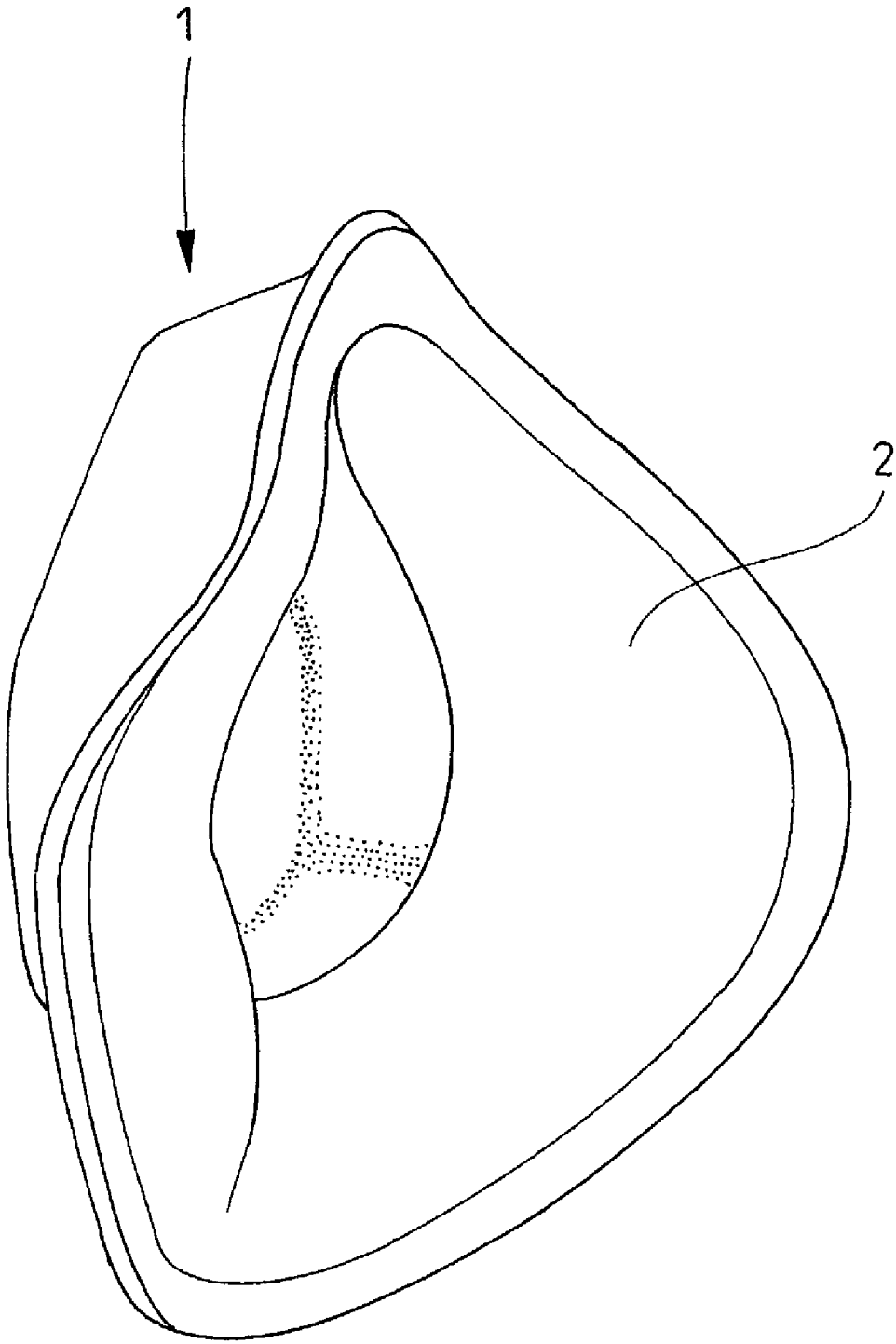
FIG. 2 is a view of the protective device of FIG. 1 from another direction.

FIGS. 1 and 2 schematically illustrate a protective device according to the invention comprising a mask part 1 which covers the wearer's mouth and nose. The mask part 1 is shown from different directions in FIGS. 1 and 2. Naturally, the mask part 1 also comprises fastening means for fastening the mask part to the front of the wearer's face so that it covers the wearer's nose and mouth. The fastening means are not shown in the figures because they represent fully conventional art to a person skilled in the art. It will suffice to state that the fastening means can be implemented using elastic straps. As regards the fastening means, a reference is also made to Finnish application no. 973847, where this detail is described in greater detail.

The mask part is also provided with means through which air for breathing can be supplied inside the mask part to enable breathing. Correspondingly, the mask part is provided with means for leading exhaled air out of the mask. The above-mentioned means are not illustrated in FIGS. 1 and 2 because a person skilled in the art is fully familiar with them. The above-mentioned means may be e.g. flap valves which allow flow in only one direction. Here a reference is also made to the above-mentioned Finnish application no. 973847.

Figure 3:
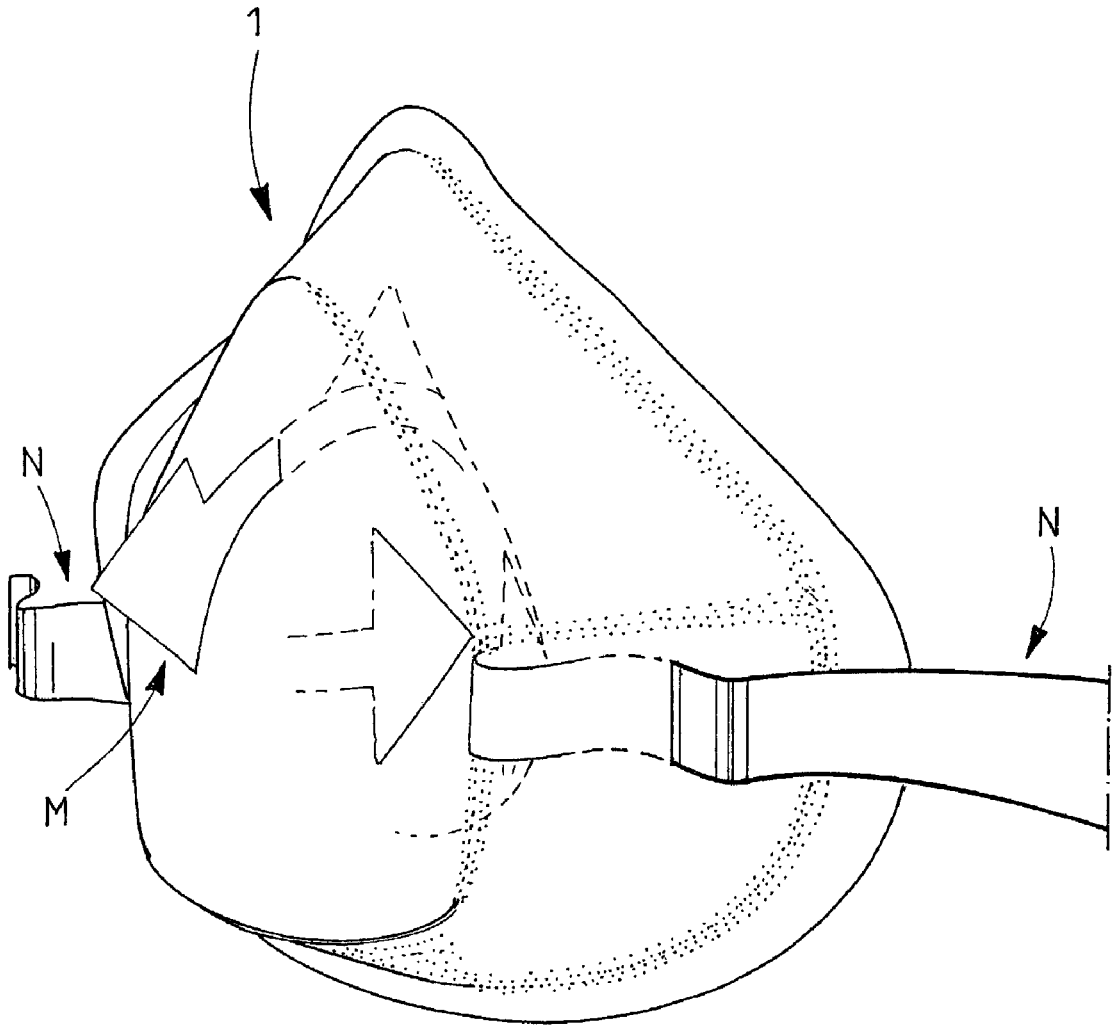
FIG. 3 is a schematic view of flow of supply air inside the protective device according to the invention.

The essential feature of the invention is that the mask part 1 is provided with a wall portion 2, which is arranged to extend from the edge portion of the mask part 1 against the wearer's face inside the mask part so that an interspace connected to the inner space of the mask part is formed between the wall portion and the inner surface of the mask part. This detail appears clearly from FIG. 2. The wall portion 2 is arranged to attach to the mask part at the edge of the mask part and form an interspace between the inner surface of the mask part and the surface of the wall portion 2 away from the wearer. The above-mentioned interspace is open towards the inner space of the mask part at the free edge of the wall portion 2. The mask part can also be designed so that the interspace is ventilated quickly. The wall portion 2 can be preferably arranged to extend round the mask part and form a continuous, circumferential interspace inside the mask part. The means for supplying air for breathing inside the mask are arranged to open into the interspace, in which case the air supplied to the mask part is first guided into the interspace formed by the wall portion 2 and the mask part 1 and then to the wearer. FIG. 3 schematically illustrates how air flows into the interspace and further to the wearer. This air flow is denoted by arrows N. The flow of exhaled air out of the mask part is denoted by arrow M.

The wall portion 2 is preferably made of an elastic, porous and thermonegative material. Furthermore, the wall portion can be preferably designed to form, at the edge of the mask part to be pressed against the wearer's face, a supporting surface which reduces the surface pressure. This supporting surface can be seen in FIG. 2.

The wall portion 2 formed inside the mask part is designed so that the flow N of supply air does not subject the wearer's skin to draught, cooling, drying or any other physical or chemical effect. The thickness and other properties of the wall portion are selected so that the wall portion fits closely against the skin at a comfortable surface pressure while the tightness of the mask part is retained. The material of the wall portion has to be as skin friendly as possible, i.e. a porous, thermonegative material. The surface structure must not be smooth so that the skin does not sweat at the sealing point. Furthermore, the material must not feel cold or hot on the skin.

Figure 4:
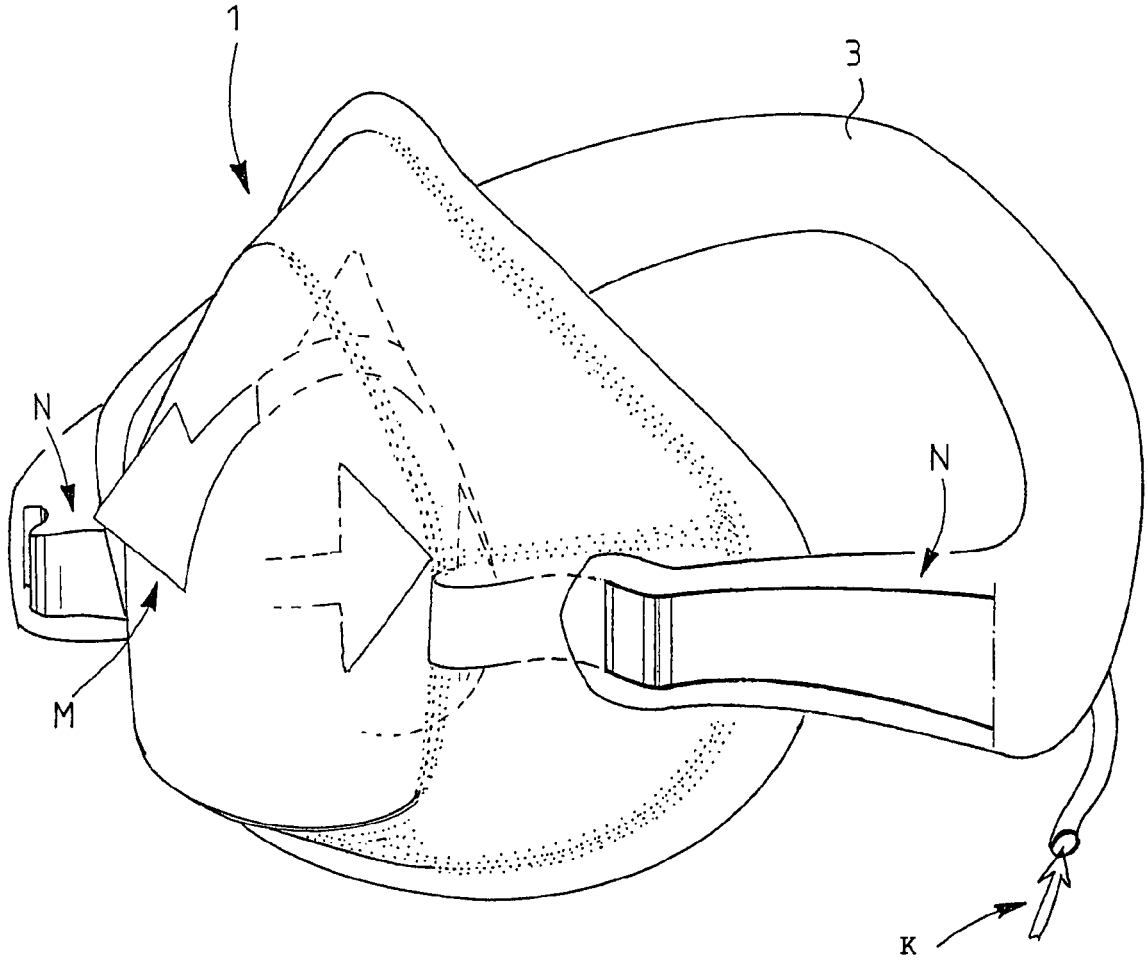
FIG. 4 is a schematic view of the protective device of the invention combined with a solution employing a structure comprising an interspace for supply air.

The protective device according to the invention can be combined in a preferred manner with different constructions of protective devices. FIG. 4 schematically illustrates an embodiment which employs a part functioning as an interspace 3 for the supply air. A connection for air supply is illustrated with arrow K in FIG. 4. The structure and function of the part 3 functioning as an interspace 3 are described in greater detain in the above-mentioned Finnish application no. 973847.

Figure 5:
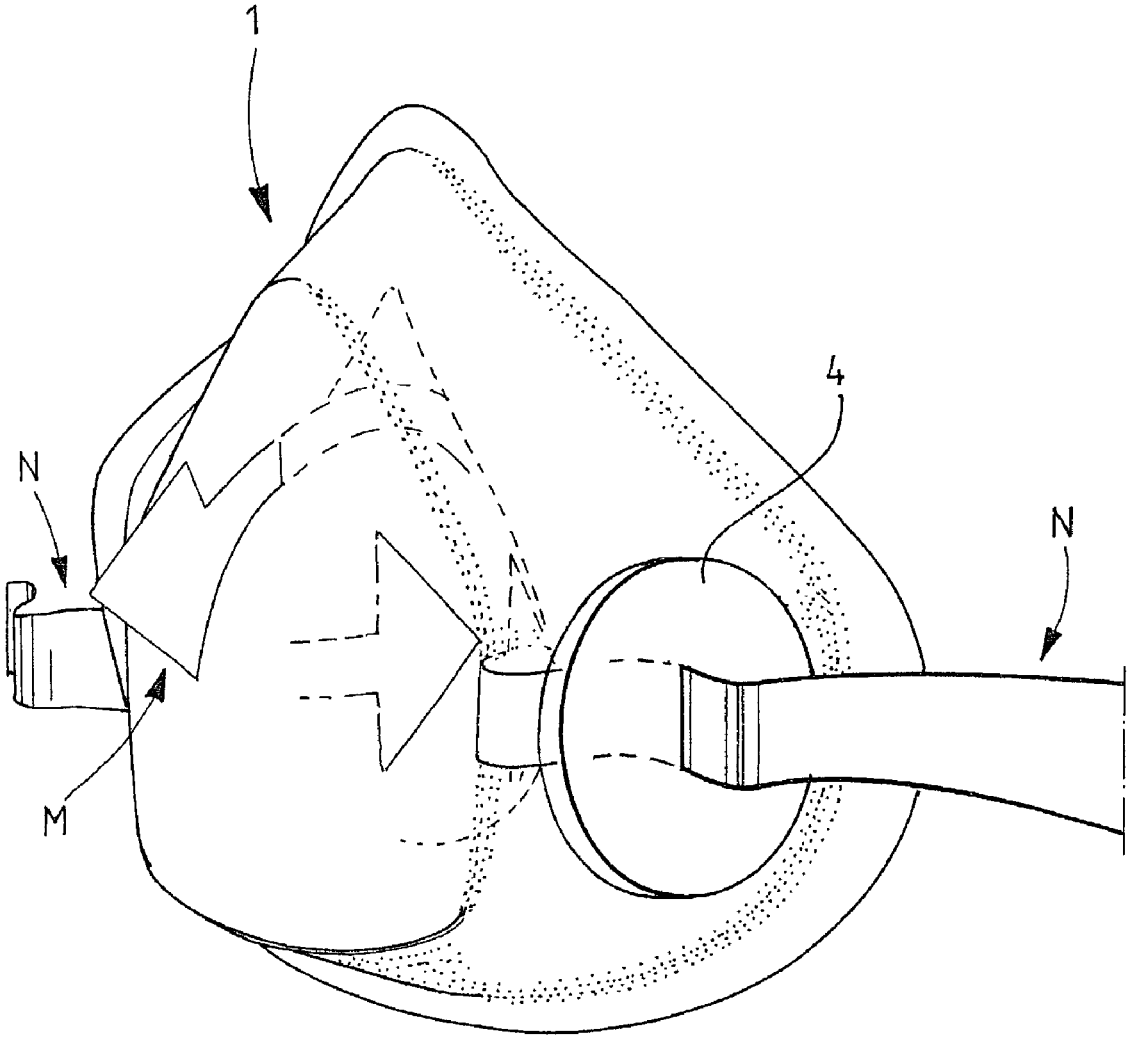
FIG. 5 is a schematic view of the protective device of the invention combined with a structure employing a solution provided with filters.

FIG. 5 illustrates a protective device of the invention combined with a solution which employs filters. Filters are marked with reference number 4.

The embodiments described above are not intended to restrict the invention in any way but the invention may be freely modified within the scope of the claims. It is thus clear that the protective device of the invention and its details need not be exactly the same as the ones shown in the figures but other solutions are also feasible.

The invention claimed is:

1. A protective device comprising:

a mask part having a front that is spaced from a wearer's face during use of the protective device and an edge portion that bears against a wearer's face during use of the protective device, and a side that extends from said edge portion to said front, said side and front defining an inner space that receives air for breathing;

a wall portion inside said mask part and that is attached to said edge portion and overlaps said side to define an interspace between said wall portion and an overlapped part of said side, said wall portion extending a first distance from said edge portion to a free edge that extends completely around an inside of said side of said mask part spaced from said front so that said interspace is open toward said inner space at said free edge; and air supply means for directing received air through said interspace into said inner space during operation of the protective device, said air supply means opening only into said interspace and being in said side entirely in a part of said side between said edge portion and a second distance from said edge portion that is less than said first distance.

2. The protective device according to claim 1, wherein said free edge defines an opening in said wall portion whose size generally corresponds to a size of said front.

3. The protective device according to claim 1, wherein the wall portion is arranged to form a supporting surface which reduces surface pressure at the edge portion of the mask part.

4. The protective device according to claim 3, wherein said air supply aperture comprise a part which functions as a further interspace for the supply air.

* * * * *